United States Patent [19]

DeForrest, Sr.

[11] Patent Number: 4,798,065

[45] Date of Patent: Jan. 17, 1989

[54] LOCK HAVING A REVERSIBLE RIGHT AND LEFT HAND BOLT

[76] Inventor: William DeForrest, Sr., 1825 Via Burton, Anaheim, Calif. 92806

[21] Appl. No.: 53,843

[22] Filed: May 26, 1987

[51] Int. Cl.[4] ..... E05B 65/06

[52] U.S. Cl. ..... 70/129; 70/134; 70/360; 70/462

[58] Field of Search ..... 70/129, 134, 360, 462; 292/150, 179

[56] References Cited

U.S. PATENT DOCUMENTS

| | | | |
|---|---|---|---|
| 955,774 | 4/1910 | Drury | 70/129 |
| 3,811,302 | 5/1974 | Sorensen | 70/129 |
| 3,953,062 | 4/1976 | Maston | 292/57 |
| 4,136,540 | 1/1979 | Corelli | 70/462 |
| 4,565,079 | 1/1986 | Smith | 70/134 |

FOREIGN PATENT DOCUMENTS

| | | | |
|---|---|---|---|
| 213937 | 3/1958 | Australia | 292/150 |

*Primary Examiner*—Robert L. Wolfe
*Attorney, Agent, or Firm*—Herb Boswell

[57] ABSTRACT

A lock mechanism having a reversible right and left hand bolt includes a lock body. The body has a bolt passageway in which the bolt is mounted so as to slide back and forth in the body. A set screw fits into a groove on the bolt to retain the bolt in the body while allowing it to slide in the bolt passageway. A detent member fits into a notch on the bolt to lock the bolt to the body. A latch member fits into a notch on the detent member to hold the detent member in engagement with the bolt. A cylinder lock is attached to the detent member to rotate the detent member. When the detent member is rotated, the notch on the detent member rotates away from the latch member and allows the detent member to move away from the bolt to unlock the bolt. The bolt can be reversed in the bolt passageway by loosening the set screw, extracting the bolt from the bolt passageway, reversing the bolt, inserting the bolt back into the body and tightening the set screw.

17 Claims, 1 Drawing Sheet

FIG. 1.
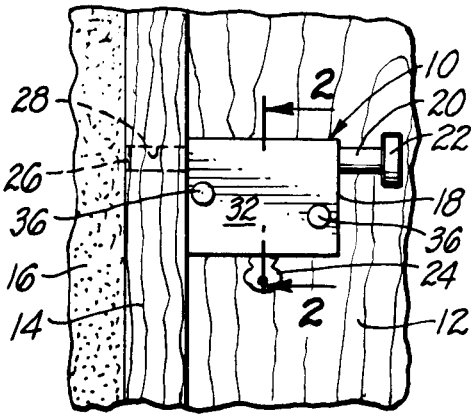
FIG. 2.
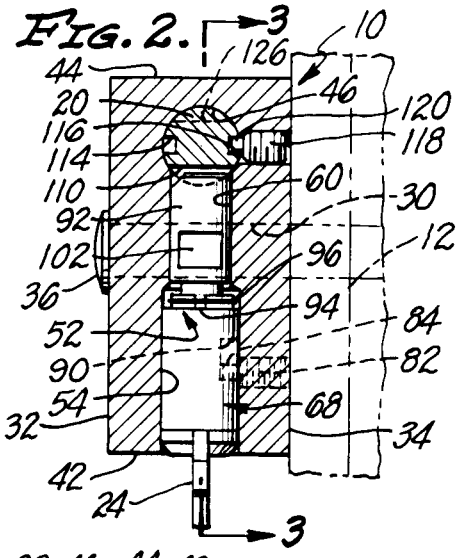
FIG. 3.
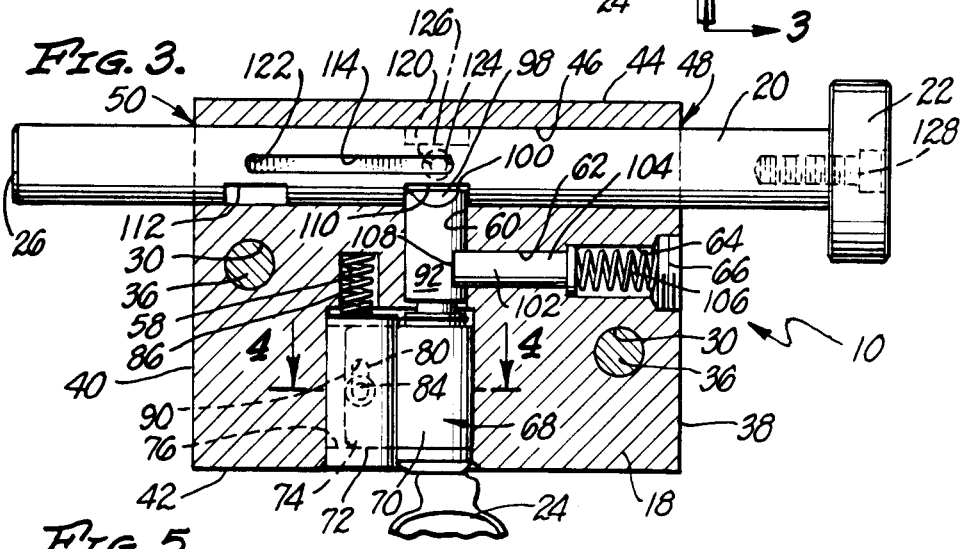
FIG. 5.
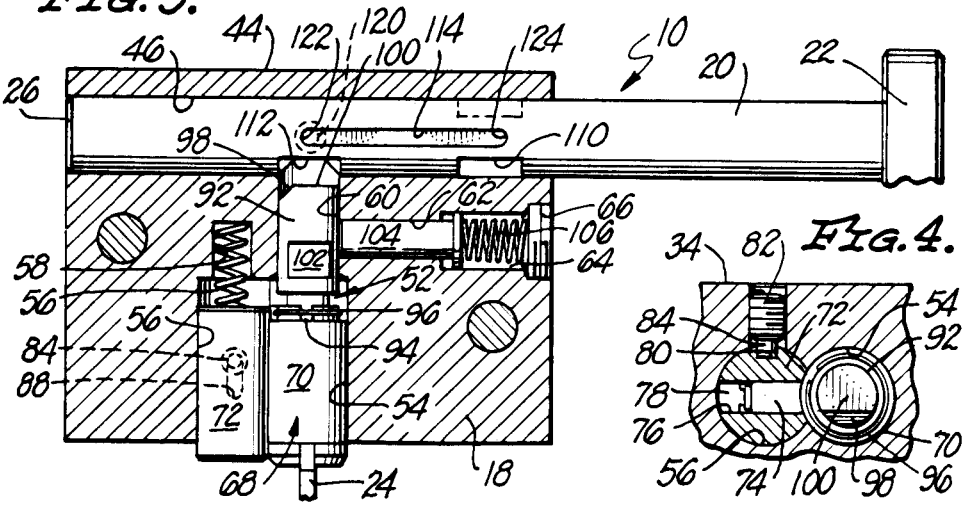
FIG. 4.

LOCK HAVING A REVERSIBLE RIGHT AND LEFT HAND BOLT

BACKGROUND OF INVENTION

This invention is directed to a lock mechanism having a bolt which can be utilized from either the right or the left hand side of the lock mechanism.

A variety of locks and lock mechanisms is known. These range from very simple padlocks to very complex high security locks. For doors which are hinged along one edge with their lock mechanism located on an edge parallel to the edge used for hinging, many high security lock mechanisms are available. On other doors such as those typified by certain type of garage doors which are hinged along tow parallel edges on either side of the door, high security locks are not available. Typically, on these doors a padlock is used in conjunction with a latch mechanism which slides back and forth sideways and engages a round opening formed in the door frame.

The locking mechanisms typically used on the above described garage doors are notoriously easy to foil. If a padlock is utilized, it can simply be removed by a pair of bolt cutters. Even if a high security padlock is utilized, the hardware latch mechanism on the garage door on which the lock is used is typically not of a sufficient diameter and/or material to resist bending, and the door can be broken into by forcefully opening the door. Once the bottom of the door is opened a small amount, because the door is hinged about a center line extending horizontally through the door, force applied to the bottom edge of the door is compounted by the lever arm between the bottom edge of the door and the center line of the door. Because the force is compounded by the lever arm, it makes it even easier to bend the latch hardware.

Aside from the above, even if the above described garage door is locked with a very secure mechanism along one side, one can still gain entrance to the garage by pulling on the opposite bottom corner of the door. This skews the door about it's hinges and about the mechanism on the opposite side. Normally, the door can be skewed enough that an unauthorized person can easily gain access to the structure wherein the door is located. To prevent this, it is necessary to place a locking mechanism on both sides of the door. This can be accomplished by positioning one of the above described padlock mechanisms on either side of the door. Because these types of doors have to be locked on both sides, heretofore any attempt to provide for a high security lock mechanism for these types of doors would have had to include both a right hand model and a left hand model. Inherently this would increase the cost of any mechanisms because of the tooling necessary to actually form two independent locks, one a right hand lock and one a left hand lock. In addition, suppliers of such lock mechanisms would have to carry two independent inventories of locks, an inventory of a right hand model and an inventory of a left hand model.

In order to avoid the problem of having to engineer and produce both a right hand model and a left hand model lock mechanism, and to carry a dual inventory, a single locking mechanism might be utilized with it being placed upright on one side, as for instance the right hand side and inverted on the other side, the left hand side. This, however, is not without its problem in that in the inverted configuration, since it would be pointed upwardly, inevitably the actual locking mechanism of such a lock structure would be exposed to environmental conditions such as rain and snow, and dust and the like. By exposing a lock mechanism to the elements in such an inverted position, inevitably a lock mechanism quickly deteriorates because of these elements.

BRIEF DESCRIPTION OF THE INVENTION

This invention provides for a new and improved lock mechanism which has a bolt which can be utilized either on the right hand side or the left hand side of the lock mechanism while still maintaining the keyway or other operator actuation means of the lock mechanism in an inverted or weather protected position. This can be advantageously achieved in a lock mechanism which includes a body having an outside surface and first and second openings located in the outside surface in opposing positions distal to one another on the body. The body includes a continuous elongated essentially straight passageway extending between the first and second openings in the body. An elongated essentially straight bolt having ends is moveably located in the bolt passageway so as to slide back and forth in the bolt passageway. The bolt is of a size longer than the bolt passageway whereby the bolt can be positioned in the bolt passageway in a first orientation with one of the ends of the bolt extending exterior of the outside surface of the body beyond the first opening.

The bolt can be further positioned in the bolt passageway in a second orientation with one of the ends of the bolt extending the exterior of the outside surface of the body beyond the second opening. A bolt movement limiting means is operatively associated between the bolt and the body. This bolt movement limiting means limits movement of the bolt between first and second limits within the bolt passageway in both the first and the second orientations. A lock means for locking and unlocking the lock mechanism is positioned in the body. A bolt retaining means for retaining the bolt in a locked position in the bolt passageway is located in the body in operative association with the lock means. The bolt retaining means is moved by the lock means between a first position wherein the bolt retaining means interacts with the bolt to retain the bolt in a locked position in the bolt passageway and in a second position where the bolt retaining means does not interact with the bolt and the bolt is free to slide between its limits and the bolt passageway.

In an illustrative embodiment, the lock means is a cylinder lock which is positionable in the body and includes a keyway for a cylinder lock key. The keyway is positioned in association with the surface of the body for ease of operation of the cylinder lock with a key. In the illustrative embodiment, the bolt movement limiting means is further capable of being disassociated with the bolt whereby the bolt in one of its first or second orientation can be withdrawn from the lock body and reinserted into the lock body in the other of its first and second orientations.

In an illustrative embodiment, the bolt retaining means includes a detent means for engaging with the bolt. The detent means is moveably located in the body in operative association with the lock means and is moved in the body by the lock means toward and away from the bolt passageway and the bolt located in the bolt passageway. In an illustrative embodiment, the lock mechanism can include a hollow chamber located within the body with the lock means moveably mounted in the chambers whereby it moves between first and second limits in the chamber. Movement of the lock means within the chamber is transferred to the detent means to move the detent means.

In an illustrative embodiment, the bolt retaining means will further include a latch means for temporarily holding the detent means in engagement with the bolt. The latch means is located in the body in operative association with the detent means. The above referred to chamber can include a detent member channel and a latch member channel, with the detent member channel located essentially perpendicular to the bolt passageway and intersecting with the bolt passageway. Further, the latch member channel is located essentially perpendicular to the detent member channel and intersecting with the detent member channel. The detent means would include a detent member moveably located in the detent channel. The latch means would include a latch member moveably located in the latch member channel. The detent member moves in the detent member channel in response to the lock means to engage and disengage wth the bolt, and the latch member moves in the latch member channel to fixedly hold the detent member in engagement with the bolt means to retain the bolt means in a locked orientation.

Additional advantages can be achieved in a lock mechanism which includes a body having first and second end faces and at least one further face which is located between the first and second faces. A straight elongated hollow bolt passageway is formed in the body between the first and second faces and intersects with these faces to form first and second openings in the first and second faces respectively. A hollow chamber is located in the body and includes a chamber opening in the further face. The chamber intersects with and connects with the bolt passageway. An elongated essentially straight bolt having ends is moveably located in the bolt passageway such that it slides back and forth in the bolt passageway. The bolt is of a size with respect to the bolt passageway allowing it to be positioned in the bolt passageway with one of its ends extending beyond the first opening and the other of its ends extending beyond the second opening.

A lock means for locking and unlocking the lock mechanism is moveably positioned in the chamber to move towards and away from the botl passageway. A bolt detent means is associated with the locking means in the bolt chamber and is moveable in the bolt chamber in conjunction with the lock means. Further, the bolt detent means is operatively associated with the bolt and capable of locking the bolt in the bolt passageway by engagement with the bolt; and unlocking from the bolt in the bolt passageway by disengaging with the bolt. Additionally, a latch means is associated with the detent means for temporarily retaining the detent means in the position wherein it locks the bolt.

In an illustrative embodiment, a bolt movement limiting means is operatively associated with the bolt and the body. The bolt movement limiting means allows movement of the bolt within the bolt passageway between the first and second limits. The bolt movement limiting means can be disassociated from the bolt to allow extraction of the bolt from the bolt passageway and reinsertion of the bolt in the bolt passageway in a different orientation.

In an illustrative embodiment, the lock means is a cylinder lock which is moveably mounted in the chamber to move between the first and second limits in the chamber. The cylinder lock movement limiting means is operatively associated between the cylinder lock and the body for limiting the movement of the cylinder lock within its limits within the chamber.

Both the bolt movement limiting means and the cylinder lock movement limiting means can each be formed to include a groove on the bolt or a groove on the cylinder lock. Further, groove engagement members are located on the body which engages with the grooves on the bolt and on the cylinder lock. The ends of the grooves on the bolt and the cylinder lock serve as limits which contact the engagement members to limit the movement of the bolt within the bolt passageway and the movement of the cylinder lock within the chamber.

Further advantages can be achieved in a lock mechanism which includes a body having an outside surface and a straight elongated hollow bolt passageway formed in the body and intersecting the surface of the body at first and second opposing openings in the surface. An essentially elongated straight bolt having ends is moveably located in the bolt passageway. It can be inserted into the bolt passageway through either of the first or second openings and it slides back and forth in the bolt passageway. The bolt is of a size with respect to the bolt passageway whereby the bolt can be positioned in a first orientation in the bolt passageway with one of its ends extending beyond the first opening and the other of its ends extending beyond the second opening; or in a second orientation in the bolt passageway with the one of its ends extending beyond the second opening and the other of its ends extending beyond the first opening. A locking means is used for temporarily retaining the bolt in a fixed position in the bolt passageway in either of its first or its second orientations.

In an illustrative embodiment, the bolt would include the above referred to bolt limiting means which will limit the movement of the bolt within the bolt passageway in either of the first or the second orientation. Additionally, at least one notch means can be located on the bolt. The locking means would be operatively engageable with the notch means to temporarily retain the bolt in a fixed position in the bolt passageway. The notch means can include at least one locking notch, and the bolt movement limiting means can include the above referred to groove and groove engagement member. The bolt can include two of said locking notches and one of said groove formed on the bolt with the notches located 90° rotated on the bolt with respect to the groove, or the bolt can include two of the grooves and one of the notches with the grooves located 90° rotated with respect to the notch.

DESCRIPTION OF THE DRAWINGS

This invention will be better understood when taken in conjunction with the drawings wherein:

FIG. 1 is an elevational view showing a lock mechanism of this invention as attached to a door which is positioned in association with a door frame structure;

FIG. 2 is a side elevational view in partial section about the lines 2—2 of FIG. 1;

FIG. 3 is a front elevational view in partial section about the lines 3—3 of FIG. 2;

FIG. 4 is a fragmentary plan view in partial section about the lines 4—4 of FIG. 3; and FIG. 5 is a view similar to FIG. 3 except certain of the components shown in FIG. 5 are in a different orientation than as seen in FIG. 3.

This invention utilizes certain principles and/or concepts which are set forth in the claims appended hereto. Those skilled in the lock smithing arts will realize realize that these principles and/or concepts are capable of being utilized in a variety of embodiments which may differ from the exact embodiment utilized for illustrative purposes herein. For this reason, this invention is not to be construed as being limited solely to the illustrative embodiments but should only be construed in view of the claims.

DETAILED DESCRIPTION OF THE INVENTION

FIG. 1 shows the lock mechanism 10 of this invention. It is attached to a garage door, a fragment which is depicted by the numeral 12. The garage door in turn is located next to a door frame 14 attached to a structure 16.

The locking mechanism 10 includes a body 18. A bolt 20 slides in the body 18 as hereinafter explained in greater detail. The bolt 20 includes a head 22 utilized to manipulate the bolt 20. A key 24 is utilized to unlock the lock mechanism 10 allowing, in FIG. 1, for the bolt 20 to be slid to the right by engaging the bolt head 22 in one's fingers. This slides end 26 of the bolt 20 out of a recess 28 formed in the door frame 14.

As seen in FIG. 1, the lock mechanism 10 is being used on the left hand side of the door 12. As utilized for a left hand side lock, the bolt 20 is operated by withdrawing it to the right as seen in FIG. 1. As hereinafter explained in greater detail, the bolt 20 can be removed from the body 18 and inserted from the left hand side of the body 18 such that the locking mechanism 10 becomes a right hand locking mechanism. In doing so, the key 24, and a keyway, hereinafter described in greater detail, still remain on the bottom of the locking mechanism 10 wherein they are protected from the accumulation of water, ice, dust, etc. within the locking mechanism.

The body 18 of the locking mechanism 10 is formed from a monolithic block of appropriate material, as for instance chrome steel, or the like. As so formed, the body 18 is essentially impervious to entry. Two methods of attachment of the body 18 to an appropriate door can be utilized. As shown in the figures, holes, collectively identified by the numeral 30, are drilled from the front face 32 through the body 18 and exit the rear face 34. The lock mechanism 10 can then be attached to an appropriate door 12 by utilizing round headed cap bolts, collectively identified by the numeral 36 in the figures. Alternatively, instead of forming holes 30 completely through the body 18, they could be formed partly through the body 18 from the rear face 34 toward the front face 32. Such holes would not open through the front face 32, but would be tapped whereby appropriate bolts could be passed through holes in a door and threaded into the holes in the rear face 34 to bring the rear face 34 tightly against the door. Thus, this secures the lock mechanism 10 to the door.

The body 18 includes a first face, the right side face 38, and a second face, left side face 40. Further, a further face, the bottom face 42 extends between the first and second faces 38 and 40. The rectangular block structure of the body 18 would be completed with a top face 44. While for the purposes of illustration of this invention, the body 18 is shown as a rectangular block, it is not necessary for the body of the locking mechanism 10 to be formed as such a rectangular block. Any appropriate shape could be utilized so long as the bolt 20 can be passed from one side completely through the body and exit out the other side of the body. Thus, for instance, the body of the lock mechanism 10 could be formed so as to be round with the surfaces 34, 38, 40, and 44 actually as one continuous surface. In any event, for the purposes of illustration, the rectangular block structure as shown in the figures will be described.

A bolt passageway 46 is formed as a straight elongated passageway passing through an opening 48 in first face 38 through the bulk of the body 18 and exiting out an opening 50 in the second face 40. In essence, the bolt passageway 46 is a cylindrical hole which passes completely through the body 18 frpom one side to the other. While for the purposes of illustration, the bolt passageway 46 is shown as being round in cross section as seen in FIG. 2, it is, of course, realized that other orientations, as for instance a square or other polygon shape, could be appropriately utilized. For ease of construction, however, a circular cross section bolt passageway 46 is easily formed in the body 18 by making an appropriate drilling through the body 18 from the face 38 to the face 40.

Several further holes drilled into the body 18 together form a chamber 52. Holes 54 and 56 are formed as large diameter holes up through the bottom face 42 into the body 18. Hole 56 is continued as a smaller diameter hole to form a spring channel 58. Hole 54 is extended at a slightly smaller diameter to form a detent channel 60. Detent channel 60 is drilled into the body 18 such that it intersects and opens up into the bolt passageway 46. Thus, it is continuous with the bolt passageway 46. As so formed in the body 18, the detent channel 60 is located perpendicular to the bolt passageway 46.

A latch channel 62 is drilled from first face 38 towards, and intersects with, the detent channel 60. The latch channel 62 is perpendicular to the detent channel 60. The outside half of the latch channel 62 is widened to form a further spring retaining channel 64. The very outside end of the spring channel 64 is tapped to received a blind plug member 66.

The holes 54 and 56 are drilled of a diameter to accept a common cylinder lock 68. The cylinder lock 68 includes a key plug section 70 and a tumbler cap 72. As is seen in FIG. 3, a tumbler case 74 is formed as a part of the key plug as is standard in cylinder locks. As is seen in FIG. 4, the tumbler cap 72 is undercut with a concave cut and includes a slot 76 in the center of the undercut such that it can slide over the tumbler cup 70 and mate securely against the plug member 66. The slot 76 does not traverse the complete length of the cylinder profile of the tumbler cap 72. This construction leaves a wall, collectively identified by the numeral 78, at both of the ends of the tumbler cap 72. The key plug 70 and the tumbler cap 72 are mated by inserting the tumbler case 74 into the slot 76. Now if the tumbler cap 72 is retained within the chamber 52, this concurrently retains the key plug 70 and anything attached thereto in the chamber 52.

The key 24 interacts with appropriate standard tumblers, not separately identified or numbered, in the key plug 70 to operate the cylinder lock 68 in a standard manner.

A groove 80 is formed on the back side of the tumbler cap 72. This can be seen in FIGS. 2, 3, and 5. The groove 80 extends along approximately ¼ of the height of the cylinder of the tumber cap 72. A set screw 82 having a small boss 84 on its end is used as an engagement member to engage the groove 80. The set screw 82 is threaded into an appropriate hole drilled into the rear face 34 of the body 18.

A compression spring 86 is first positioned in the spring retaining channel 80. Then the cylinder lock 68 and a further member attached thereto, as hereinafter explained, are loaded into the chamber 52. The cylinder lock 68 is retained in the chamber 52 by threading the set screw 82 into the rear face 35 of the body 18 until the boss 84 engages and is located in the groove 80 on the tumbler cap 72. The boss, however, 84 does not "bottom out" or mate tightly against the bottom of the groove 80, but is slightly displaced upwardly or to the right, as seen in FIG. 2, from the bottom of the groove 80. This allows the cylinder lock and components attached thereto to slide or move upwardly and downwardly within the chamber 52 an increment amount determined by the ends 88 and 90 of the groove 80 contacting the boss 84. Thus, if nothing else inhibits movement of the cylinder lock 68 in the chamber 52, the compression spring 86 will push the cylinder lock 68 downwardly until the upper end 90 of the groove 80 contacts the boss 84 on the set screw 82. And if the cylinder lock 68 is pushed upwardly within the chamber 58, its upward movement is limited by contact of the end 88 of groove 80 against the boss 84 on the set screw 82. The ends 8 and 90 of the groove 80, thus, serve as movement limit stops for movement of the cylinder lock 68 in the chamber 52.

A detent member 92 has a small key 94 formed on one of its ends. This key fits into an appropriate slot on the end of the key plug 70 and is retained in this slot by a retaining ring 96. The use of a member having a key 94 on its end being retained by a retaining ring in a slot in a plug member 66 is as is standard with other cylinder locks. The detent member 92 is not, however, a standard implement normally associated with a cylinder lock.

A face 98 is formed at an angle along the upper end 100 of the detent member 92. A notch 102 is formed in the side cylindrical surface of the detent member 92. The notch 102 is located on the detent member 92 in a position such that when the cylinder lock 68 is pushed upwardly into the chamber 52 positioning the boss 84 and the set screw 82 near the bottom end 88 of the groove 80, the notch 102 lines up with the latch channel 62. When the cylinder lock 68 is allowed to descend downwardly in the chamber 58 under the bias of the compression spring 88, the notch 102 moves downwardly out of alignment with the latch channel 62.

A latch member 104 is loaded into the latch channel 62. It is retained in the latch channel 62 via a compression spring 106 which fits between the head of the latch member 104 and the plug member 66. The spring 106 urges the latch member 104 to the left as seen in the figures. When the cylinder lock 68 is moved upwardly within the chamber 52 and the key plug member 68 rotated by the key 24, this rotates the detent member 92 such that the notch 102 on the detent member 92 is aligned with the latch channel 62. The latch member 104 can now move or extend out of the latch channel 62 into the detent channel 60 to engage the notch 102 in the detent member 92 holding the detent member 92 in a position as is seen in FIG. 3.

When the key 24 is rotated in the key plug 70 rotating the key plug 20 and the detent member 92 attached thereto, the notch 102 on the detent member 92 rotates away from the latch member 104 whereby the end 108 of the member 104 rides up on the cylindrical surface of the detent member 92 depressing the latch member 104 to the right into the latch channel 62 compressing the spring 106. When the latch member 104 is retracted back into the latch channel 62 by rotation of the detent member 92, the detent member 92 under the bias of the spring 86 transmitted through the cylinder lock 68 is moved downwardly in the detent channel 60 to the position as seen in FIG. 5.

The bolt 20 includes a first locking notch 110 formed therein. The locking notch 110, and other locking notches as hereinafter explained, are sized to receive the upper end 100 of the detent member 92. If the bolt 20 is positioned as seen in FIG. 3, the cylinder lock 68 can be pushed upwardly in the chamber 52 such that the upper end 100 of the detent member 92 engages the locking notch 110 in the bolt 20. If, at the same time, the cylinder plug 70 and the detent member 92 located thereon, are appropriately rotated such that the latch member 104 can engage the notch 102 on the detent member 92, the latch member 104 moves to the left in the figures locking in the notch 102. The latch member 104 locks the detent member 92 in its upward or locking position which, in turn, locks the bolt 20. This position is chosen as the position wherein the key 24 can be removed from the key plug 70. As such, the locking mechanism 10 is now locked and the bolt 20 cannot be moved either to the left or to the right in the body 18.

To unlock the locking mechanism 10, the key 24 is inserted into the key plug 70 and rotated. As described above, this rotates the notch 102 with respect to the end of the latch member 104 freeing the notch 102 from the latch member 104 allowing the cylinder lock 68 to descend in the chamber 52. This retracts the detent member 92 from the notch 110 in the bolt 20, unlocking the bolt 20 such that it is free to slide in the bolt passageway 46.

A further notch 112 can also be formed on the bolt 20 whereby when the bolt is retracted to the right in the position as seen in FIG. 5, it is possible to lock the locking mechanism 10 in an unlocked position. In an alternate embodiment of the invention, the notch 112 would not be utilized and would be absent from the bolt 20. In that embodiment, locking mechanism 10 could not be locked in an unlocked position.

The bolt 20 includes a first groove 114 formed on one side, and a second groove 116 formed on its other side rotated 180° from the first groove 114. A further set screw 118, having a boss 120 on the end thereof, is utilized to engage one or the other of the grooves 114 and 116 on the bolt 20. Thus, as is seen in FIG. 3, the boss 120 on the set screw 118 would be utilized to engage the groove 116 on the back side of the bolt 20. As with prior described groove 80 on the cylinder lock 68, the grooves 114 and 116 each have left and right ends, 122 and 124 (only those of groove 114 being shown in the figures), which serve as limit stops for the bolt 20 in the bolt passageway 46.

As is seen in the figures, when the bolt 20 is located in the body 18 such that the lock mechanism 10 is a left handed lock mechanism, the bolt 20 can be slid in the position seen in Fig. 3, wherein the boss 120 is bottomed out against the right side end of the groove 116, to a position seen in FIG. 5 wherein the boss 120 is bottomed out against the left side end of the groove 116. Thus, the bolt 120 is retained in the body 18, but is free to slide from its locked position, as seen in FIG. 3, to its unlocked position, as seen in FIG. 5. The ends 122 and 124, in the groove 114 (and their unseen counterparts in the groove 116) are appropriately positioned with respect to the notch 110 (and the notch 112 if it is utilized) such that these align directly over the detent channel 60 when the bolt 20 is either in its locked or unlocked position.

To convert the locking mechanism 10 from a left hand locking mechanism, as seen in the figures to the right hand locking mechanism, the set screw 82 is retracted away from the bolt 20 until its boss 120 is no longer located within the groove 116. The bolt 20 can then be moved all the way to the right and withdrawn from the opening 48. It can then be reinserted in the left hand side of the body 18 through the opening 50. When it is so reinserted, it has been essentially rotated 180°. Now the groove 114 is aligned next to the boss 120 on the set screw 118. The set screw 118 is then tightened into the body 18 to position the boss 120 within the groove 114. The lock mechanism 10 has now been converted to a right hand lock mechanism with the bolt 20 moving to the left to unlock the lock mechanism 10, and to the right to lock it.

In rotating the bolt 20 such that the head 22 is moved from the right hand side of the lock mechanism 10 to the left hand side of the lock mechanism 10, the locking notch 110 (and the notch 112 if it is utilized) is maintained oriented in a downward directed position allowing it to still be engaged by the detent member 92. By providing two grooves, 114 and 116, which are both located 90° with respect to the locking notch 110, the bolt 20 can serve as both a left hand locking bolt and a right hand locking bolt.

In alternate construction, instead of providing two grooves 114 and 116 on opposite sides of the bolt 20, only one groove is provided and a further locking notch 126 is provided on the bolt 120 rotated 180° around the cylindrical surface of the bolt 20. In this embodiment in switching from a left hand to a right hand locking mechanism, when the bolt 20 is retracted from the opening 48 and inserted into the opening 50, it is also rotated 180° about its longitudinal axis such that the locking notch 126 is now oriented downwardly. Alternatively, either two grooves and one locking notch can be provided, or two locking notches and one groove can be provided on the bolt 20 to allow the bolt 20 to be utilized for both a left hand locking bolt and a right hand locking bolt.

In a further embodiment, both two locking notches and two grooves can be utilized, with one groove of a particular length and a further groove of a different length, such that the amount of "throw" of the bolt with respect to the body is changed. That is, the first groove will be sized such that the end 26 of the bolt 20 can be positioned a first distance away from a face, as for instance face 50, and the second groove will be of a different length such that the end 26 can be positioned a different distance from a face, such as the face 50. Thus, in reinserting the bolt 20 either through the left hand side of the body 18, or the right hand side of the body 18, and in combination with rotating the bolt 20 180° to reposition either the locking notch 126 downwardly or the locking notch 110 downwardly, the combination of both left hand and right hand characteristics, as well as different bolt "throw" length characteristics, can be achieved with the locking mechanism 10.

In installing the locking mechanism 10, it is first decided whether it will be a left hand or a right hand mechanism, and the bolt 20 appropriately positioned in the body 18 and the set screw 118 secured to position its boss 120 in one or the other of the grooves 114 or 116, depending on the orientation of the bolt 20. Further, the cylinder lock 68 is positioned in the chamber 52 and appropriately keyed to a particular keying combination. It is then moveably fixed within the chamber 52 by screwing in the set screw 118 until its boss 84 engages the groove 80.

The locking mechanism 10 can now be mounted on a door, as described above. When so mounted, the set screws 82 and 118 are positioned flush against the door and are not available for unauthorized manipulation thereof. Thus, when once fixed to the door, the bolt 20 is permanently held within the body 18 as is the cylinder lock 68. However, the bolt 20 is free to move within its limits of travel as determined by the interaction of the boss 120 on the set screw 118 in one or the other of the grooves 114 and 116. And the cylinder lock is free to travel upwardly and downwardly in the chamber 52 by the interaction of the boss 84 on the set screw 82 fitting into the groove 80.

In locking at the unlocked configuration as is seen in Fig. 5, the key 24 can be rotated to the position seen in FIG. 1 and withdrawn from the cylinder lock 68. The bolt 20 can now be slid to the left into a locking position and the cylinder lock 68 pushed upwardly in the chamber 52 against the bias of the spring 86. This engages the detent member 92 in the locking notch 120 and simultaneously engages the latch member 104 in the notch 102 on the detent member 92. This locks the lock mechanism 10 and prevents further movement of the bolt 20. To unlock the lock mechanism 10, the key 24 is reinserted into the cylinder 68 and rotated to rotate the notch 104 on the detent member 92 away from the latch member 104 allowing the detent member 92 to descend downwardly under the bias of the spring 86 transferred through the cylinder lock 68. This frees the detent member 92 from the locking notch 110 in the bolt 20 allowing the bolt 20 to be slid to the right within the confines of the limits of the boss 120 on the set screw 118 interacting with groove 116.

As can be seen from FIGS. 3 and 5, the set screw 118 is directly centered over detent channel 60 such that when the bolt 20 is siwtched from a orientation as seen in FIGS. 3 and 5 to one wherein it changes the locking mechanism to a right hand locking mechanism, the locking notch 110 (or the locking notch 126 if it is utilized) will still be exactly centered over the detent channel 60 when the end of the groove 114 contacts the boss 120 on the set screw 118. Thus, the operation of the locking mechanism 110 is exactly the same in both a left hand and a right hand operation. The face 98 on the detent member 92 assists in moving the detent member 92 across the latch member 104 when the locking mechanism 10 is constructed. This is done by rotating the key 24 until the face 98 is oriented toward the latch channel 62 and then pushing the combination of the cylinder lock 60 and the detent member 92 attached thereto upwardly. The face 98, since it is beveled, interacts with the latch member 104 pushing it to the right, allowing the detent member 92 to be slid upwardly past the latch member 104.

As can be seen in the figures, the head 22 is attached to the bolt 20 via an appropriate screw 128. The head 22 is formed as a circular disk of a diameter which is less then the thickness of the body 18 between its front and rear faces, 32 and 34, such that it doesn't interfere with movement of the bolt 20 but still provides for a convenient place for one to grasp with one's fingers to operate the bolt 20. Other appropriate head geometries could be considered as long as they didn't interfere with the operation of the lock mechanism 10.

I claim:

1. A lock mechanism which comprises:

a mechanism body, said mechanism body having an outside surface, said body including first and second openings located in said outside surface of said body in opposing positions distal to one another on said body;

said body having a continuous elongated essentially straight bolt passageway extending between said first opening and said second opening;

an elongated essentially straight bolt having ends, said bolt movably located in said bolt passageway to slide back and forth in said bolt passageway, said bolt of a size longer than said bolt passageway whereby said bolt can be positioned in said bolt passageway in a first orientation with one of said ends of said bolt extending exterior of said outside surface of said body beyond said first opening and said bolt can be further positioned in said bolt passageway in a second orientation with one of said ends of said bolt extending exterior of said outside surface of said body beyond said second opening;

bolt movement limiting means operatively associated between said bolt and said body for limiting movement of said bolt between first and second limits in said bolt passageway in both of said first and second orientations;

a lock means for locking and unlocking, said lock means including an operator means for locking and unlocking said lock means, said lock means positioned in said body such that said operator means is positioned in association with said surface of said body so as to be accessible from the exterior of said body; and a bolt detent member for retaining said bolt in a locked position in said bolt passageway, said bolt detent member located in said body in operative association with said lock means and moved both rotationally and translationally by said lock means between a first position wherein said bolt detent member interacts with said bolt to retain said bolt in said locked position in said bolt passageway and a second position wherein said bolt detent member does not interact with said bolt and said bolt is free to slide between said limits in said bolt passageway.

2. The lock mechanism of claim 1 wherein:

said lock means is a cylinder lock;

said cylinder lock positionable in said body; and said cylinder lock including a key way for a cylinder lock key, said key way operatively positioned in association with said surface of said body for operating said cylinder lock with a key.

3. The lock mechanism of claim 1 including:

said bolt movement limiting means further capable of being disassociated from said bolt whereby said bolt can be withdrawn from said mechanism body and reinserted into said mechanism body in a different of said first and second orientation than it was in when it was withdrawn from said body.

4. The lock mechanism of claim 1 including:

said mechanism body formed as a monolithic body;

a hollow chamber located in said body, said chamber including a chamber located in said outside surface of said body, said chamber further intersecting with and connecting to said bolt passageway; and said lock means movably mounted in said chamber to move between first and second limits in said chamber, movement of said lock means in said chamber between said limits being transferred to said detent member to translationally move said detent member.

5. The lock mechanism of claim 4 including:

a lock means movement limiting means operatively associated between said lock means and said body for limiting movement of said lock means within its said limits in said chamber.

6. The lock mechanism of claim 1 further including:

latch means for temporarily holding said detent member in engagement with said bolt against translational movement, said latch means located in said body in operative association with said detent member.

7. The lock mechanism of claim 4 wherein:

said chamber includes a detent member channel and a latch member channel, said detent member channel located essentially perpendicular to said bolt passageway and intersecting with said bolt passageway, said latch member channel located essentially perpendicular to said detent member channel and intersecting with said detent member channel;

said detent member movably located in said detent member channel, at least a portion of said detent member movable from said detent member channel into said bolt passageway to engage said bolt, said detent member moved both rotationally and translationally by said lock means in said detent channe; and said latch means including a latch member, said latch member movably located in said latch member channel, at least a portion of said latch member movable from said latch member channel into said detent channel to engage said detent member and fixedly hold said detent member against translational movement maintaining said detent member in engagement with said bolt.

8. A lock mechanism which comprises:

a body, said body including first and second end faces and at least one further face, said end faces located distal to one another on said body with said further face interspaced between said first and second end faces;

a straight elongated hollow bolt passageway formed in said body between said first and said second faces and intersecting said first and said second faces forming a first opening in said first face and forming a second opening in said second face;

a hollow chamber located in said body, said chamber including a chamber opening located in said further face, saaid chamber further intersecting with and connecting to said bolt passageway;

an elongated essentially straight bolt having ends, said bolt movably located in said bolt passageway to slide back and forth in said passageway, said bolt of a size with respect to said passageway whereby said bolt can be positioned in said bolt passageway with one of its ends extending beyond said first opening and the other of its ends extending beyond said second opening;

a lock means for locking and unlocking, said lock means located in said chamber, said lock means movable in said chamber towards and away from said bolt passageway;

a bolt detent means for holding said bolt in a fixed position, said bolt detent means located in said chamber in operative association with said lock means and movable in said chamber in conjunction with movement of said lock means between a locking position wherein said bolt detent means fixedly retains said bolt in a fixed position in said bolt passageway and an unlocked position wherein said bolt is free to move in said bolt passageway; and a latch means for engaging with said detent means and temporarily retain said detent means in said locking position, said latch means located in said chamber in operative association with said detent means.

9. The lock mechanism of claim 8 including:

bolt movement limiting means operatively associated between said bolt and said body for limiting movement of said bolt in said bolt passageway between first and second limits in said bolt passageway.

10. The lock mechanism of claim 8 including:

said lock means comprises a cylinder lock;

said cylinder lock being movably mounted in said chamber to move between first and second limits in said chamber, movement of said cylinder lock in said chamber being transferred to said detent means to move said detent means; and a cylinder lock movement limiting means operatively associated between said cylinder lock and said body for limiting movement of said cylinder lock within its said limits in said chamber.

11. A lock mechanism of claim 10 wherein:

said cylinder lock movement limiting means includes an elongated groove means for defining a path having first and second limits, said groove means located on one of said cylinder lock or said body; and said cylinder lock movement limiting means further including a groove engagement means for engaging with said groove means, said groove engagement means located on the other of said cylinder lock or said body, said groove engagement means operatively engageable with said groove means and capable of moving in a path with respect to said groove means between said first and second limits.

12. A lock mechanism of claim 8 including:

said bolt sized and shaped so as to be removable from said bolt passageway and inserted in either one of two orientations;

in a first of said orientations, one end of said bolt fitting into said first opening in said body, through said bolt passageway and then extending out of said second opening;

in a second of said orientations, the other end of said bolt fitting into said first opening in said body, through said bolt passageway and then extending out of said second opening; and said bolt detent means engageable with said bolt in either of said orientations.

13. A lock mechanism which comprises:

a body, said body having an outside surface;

a straight elongated hollow bolt passageway formed in said body and intersecting said surface of said body forming first and second opposing openings in said surface;

an elongated essentially straight bolt having ends, said bolt movably locatable in said bolt passageway so as to be insertable into said bolt passageway through either of said first or second openings and to slide back and forth in said passageway, said bolt of a size with respect to said passageway whereby said bolt can be positioned in a first orientation in said bolt passageway with one of its ends extending beyond said first opening and the other of its ends extending beyond said second opening and in a second orientation in said bolt passageway with said one of its ends extending beyond said second opening and said other of its ends extending beyond said first opening;

locking means for temporarily retaining said bolt in a fixed position in said bolt passageway in its said first orientation and in its said second orientation;

a groove cut only a portion of the way into said bolt along the elongated axis of said bolt and positioned on said bolt such that it is completely located within said body irrespective of said bolt being in either of its first or second orientations, said groove having first and second ends, said ends forming limit stops;

an engagement member located on said body in a position to be extendible into said bolt passageway, said engagement member temporarily positionable in said groove when said bolt is located in said bolt passageway whereby when said engagement member is in position in said groove the limits of movement of said bolt sliding back and forth in said bolt passageway is governed by said engagement member contacting said first and second ends of said groove.

14. The lock mechanism of claim 13 further including:

at least one notch means located on said bolt, said locking means operatively engageable with said notch means to temperatory retain said bolt in a fixed position in said bolt passageway.

15. The lock mechanism of claim 14 wherein:

said notch means includes at least one locking notch formed on said bolt.

16. The lock mechanism of claim 15 wherein:

said bolt includes one of (a) two of said locking notches and one of said grooves formed on said bolt or (b) two of said grooves and one of said locking notches formed on said bolt;

each locking notch on said bolt located on said bolt in a position rotated 90° from a groove on said bolt; and each groove on said bolt located ons aid bolt in a position rotated 90° from a locking notch on said bolt.

17. The lock mechanism of claim 1 wherein:

said bolt movement limiting means includes a groove and an engagement member;

said groove located in said bolt by cutting said groove only a portion of the way into said bolt along the elongated axis of said bolt, said groove further positioned on said bolt such that it is completely located within said body irrespective of said bolt being in either of its first or second orientations, said groove having first and second ends, said ends forming limit stops; and said engagement member located on said body in a position to be extendible into said bolt passageway, said engagement member temporarily positionable in said groove when said bolt is located in said bolt passageway whereby when said engagement member is in position in said groove the limits of movement of said bolt sliding back and forth in said bolt passageway is governed by said engagement member contacting said first and second ends of said groove.

* * * * *

UNITED STATES PATENT AND TRADEMARK OFFICE

CERTIFICATE OF CORRECTION

PATENT NO. : 4,798,065

DATED : JANUARY 17, 1989

INVENTOR(S) : WILLIAM DE FORREST, SR.

It is certified that error appears in the above-identified patent and that said Letters Patent is hereby corrected as shown below:

Column 1, line 16, "tow" should be --two--.

Column 1, line 33, "compounted" should be --compounded--.

Column 2, line 32, delete "the" after "extending".

Column 3, line 21, "wth" should be --with--.

Column 3, line 47, "botl" should be --bolt--.

Column 6, line 17, "frpom" should be --from--.

Column 7, line 16, "boss, however, 84" should be --boss 84, however,--.

Column 7, line 33, "8" should be --88--.

Column 8, line 4, "20" should be --70--.

Column 10, line 24, "116. And" should be --116 and--.

Column 10, line 28, "locking" should be --looking--.

Column 10, line 50, "siwtched" should be --switched--.

Column 10, line 50 "a orientation" should be --an orientation--.

Column 12, line 6, insert --opening-- between "chamber" and "located".

UNITED STATES PATENT AND TRADEMARK OFFICE

CERTIFICATE OF CORRECTION

PATENT NO. : 4,798,065

DATED : JANUARY 17, 1989

INVENTOR(S) : WILLIAM DE FORREST, SR.

It is certified that error appears in the above-identified patent and that said Letters Patent is hereby corrected as shown below:

Column 12, line 39, "channe" should be --channel--.

Column 12, line 62, "saaid" should be --said--.

Column 13, line 18, "retain" should be --retaining--.

Column 14, liine 57, "ons aid" should be --on said--.

Signed and Sealed this

Twentieth Day of November, 1990

*Attest:*

*Attesting Officer*

HARRY F. MANBECK, JR.

*Commissioner of Patents and Trademarks*